United States Patent [19]

Nishimura et al.

[11] 4,010,433

[45] Mar. 1, 1977

[54] ELECTROMAGNETIC RELAY

[75] Inventors: Hiromi Nishimura, Takaishi; Kenji Ono, Neyagawa; Katsumi Tachibana, Tsu; Satoru Furukawa, Kadoma, all of Japan

[73] Assignee: Matsushita Electric Works, Ltd., Osaka, Japan

[22] Filed: July 28, 1975

[21] Appl. No.: 599,640

[30] Foreign Application Priority Data

Aug. 22, 1974 Japan ..... 49-97316

[52] U.S. Cl. ..... 335/129; 335/202

[51] Int. Cl.[2] ..... H01H 50/04

[58] Field of Search ..... 335/106, 129, 128, 203, 335/202, 132, 187, 115, 126

[56] References Cited

UNITED STATES PATENTS

| | | | |
|---|---|---|---|
| 3,553,729 | 1/1971 | Mori et al. | 335/106 |
| 3,701,062 | 10/1972 | Koga et al. | 335/202 |
| 3,717,829 | 2/1973 | Flaherty | 335/202 |
| 3,800,252 | 3/1974 | Aigner | 335/129 |
| 3,828,286 | 8/1974 | Bain | 335/202 |

*Primary Examiner*—Harold Broome
*Attorney, Agent, or Firm*—Leydig, Voit, Osann, Mayer & Holt, Ltd.

[57] ABSTRACT

A flat type electromagnetic relay wherein respective members forming normally closed contacts and normally opened contacts and actuating such contacts are stacked on one another to substantially enclose electromagnet assembly of which core and coil frame are integrally formed to be flat. A balance spring urges a card operatively coupled to an armature of the assembly into non-attracted position of the armature for normal positions of the contacts with a balanced constant force with reference to attracting force to the armature and resilient force of normally opened contact spring. The assembly includes means for positioning the respective members when assembled with a single assembling direction.

9 Claims, 9 Drawing Figures

ELECTROMAGNETIC RELAY

This invention relates to an electromagnetic relay using a flat type electromagnet and formed to be flat as a whole and, more particularly, to an electromagnetic relay which can be assembled by inserting into a casing all members superposed on one another in only one vertical assembling direction.

It is preferable that any electromagnetic relay of this kind is formed to be flat or thin so as to be effectively fitted to a printed base plate in which the electromagnetic relay is to be incorporated. There are different cases of incorporating the electromagnetic relay into the printed base plate, in one of which generally the fitting area occupied by the electromagnetic relay on the printed base plate is required to be narrowed and in the other of which the height of fitting the electromagnetic relay on the printed base plate is required to be limited.

Further, in this kind of electromagnetic relay, in case it is incorporated into a printed base plate where the input is relatively small, it will be desired to operate at a low input or, in other words, to be high in the sensitivity so as to be able to be driven even through a semiconductor or the like. On the other hand, when it is generally used at random in general electric devices, it will have to be provided with a contact capacity from a low level to a high level and, therefore, it will be desired to be able to allow a high output, that is, to positively have a contact opening and closing ability even for a high capacity.

In conventional electromagnetic relays, though the semiautomation of their production has been advanced, the electromagnetic relays are not so formed as to be assembled through a positioning means in them and with only one assembling direction and, therefore, human labor has had to be still used partly. As a result, the high cost of production of electromagnetic relays has been unavoidable. Particularly, in case an electromagnetic relay is used for a printed base plate, the relay will be desired to be small. However, the conventional relay has no formation which can be made small for that purpose and the object has not been attained to a satisfactory degree.

An object of the present invention is to provide an electromagnetic relay wherein respective members are vertically superposed on one another in one assembling direction and are insured in the relative positions through a positioning means so that a perfect automation can be achieved and the production cost can be reduced.

Another object of the present invention is to provide an electromagnetic relay wherein a normally closed side contact and normally opened side contact are located respectively on both sides in the longitudinal direction of the electromagnet assembly and the contour of the apparatus is so arranged as to be formed as a thin rectangle and can be made smaller.

A further object of the present invention is to provide an electromagnetic relay wherein respective members are held as positioned easily with a high accuracy with respect to an electromagnet assembly and are provided with a fixed spring load.

Another object of the present invention is to provide an electromagnetic relay which can be operated at a low input and is provided with a contact capacity from a low level to a high level.

A further object of the present invention is to provide an electromagnetic relay of which height can be made small, that is, which can be used as a flat type in case the terminal part is subjected to a certain modification so that the height of the relay on the printed base plate will be limited.

Other objects and advantages of the present invention will become clear when references are made to the following disclosures detailed with reference to preferred embodiments shown in the accompanying drawings, in which.

Figure 1:
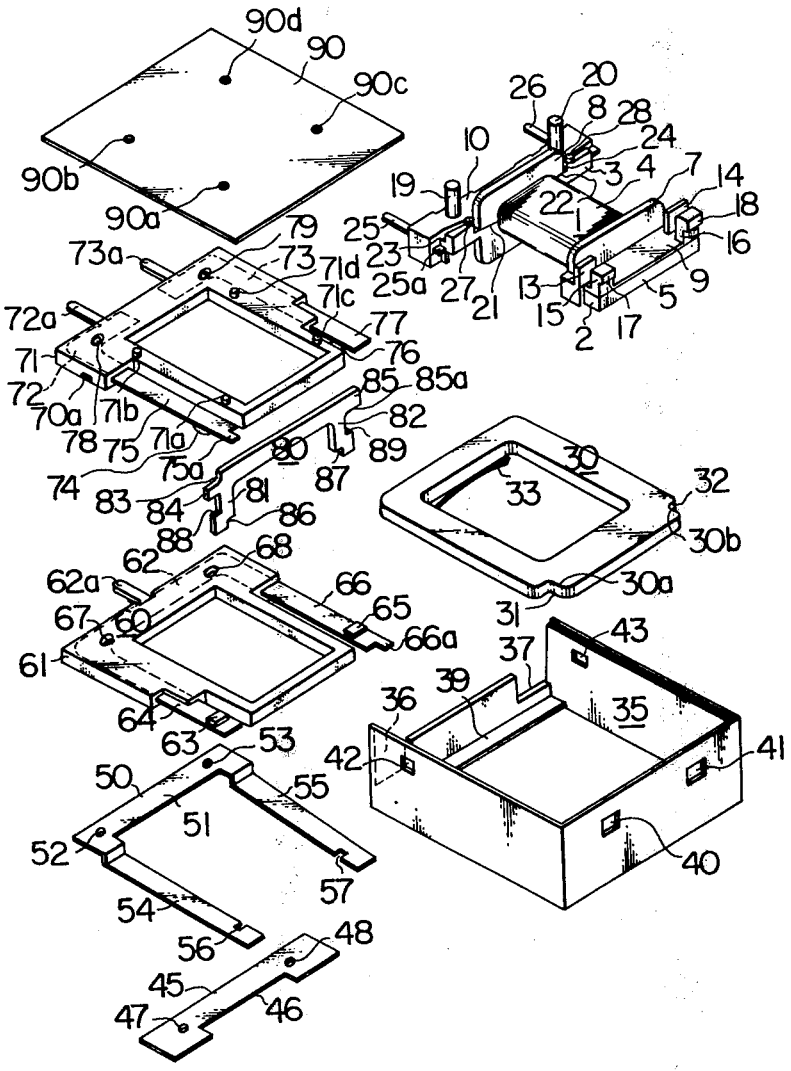
FIG. 1 is a perspective view of all component members as disassembled of an embodiment of the electromagnetic relay according to the present invention.

Though the present invention allows many various modifications and selections only specific preferred embodiments shall be shown in the drawings and detailed in the following. However, it will be understood that the present invention is not limited to the particular embodiments disclosed, but is rather to include all possible modifications, alterations and equivalent arrangements within the scope of appended claims.

Referring now to the drawings, in FIG. 1, component members of a preferred embodiment of the electromagnetic relay are shown as disassembled. There is shown an electromagnet assembly 1, wherein a coil 4 is wound on the middle part of an integral iron core 2 and plastic-made coil frame 3. The iron core 2 extends laterally at its longitudinal both ends so as to be provided with expanded parts 5 and 6 (see also FIG. 3) so that magnetic resistance at a part abutting associated armature for supporting it will be small as will be described later while the area effective for attracting the associated armature and thus the electromagnetic attracting force with respect to the armature will be large, whereby the action of the armature as attracted by the iron core 2 will become very high in the sensitivity.

The coil frame 3 formed of an electrically insulative material as molded simultaneously with the iron core 2 includes a pair of flange parts 7 and 8, between which the coil 4 is wound and these flange parts 7 and 8 are extended further in the longitudinal direction of the frame 3. That is, the flange part 7 has an extended part 9 which has an area substantially equal to that of the corresponding expanded part 5 of the iron core, while the flange part 8 has an extended part 10 which is further expanded in the lateral direction out of the corresponding expanded part 6 of the iron core. As seen best in FIG. 3, the back surfaces on both sides in the lateral direction of the extended part 10 are so formed as to hold the expanded part 6 at both sides thereof and to be flush with the surface of the expanded part 6, and guide projections 11 and 12 between which corner parts of the later detailed armature to be incorporated can be engaged are provided so as to project out of outward corner parts of said back surface of the extended part 10 for guiding and positioning the armature when the same is assembled. Further, the guide projections 11 and 12 are preferably formed to expand outward on the outside surfaces, so that they will be engaged in half opened notches of the later described casing so as to be flush with the surface of the casing.

Inner projections 13 and 14 and outer projections 15 and 16 for slidably holding a later described card are provided as opposed to each other at a proper spacing so as to project out of both edges in the lateral direction of the expanded part 9 as separated from the flange part 7, so that later described first and second contact spring blocks can be inserted on one side between the flange part 7 and the inner projections 13 and 14. Further, projections 17 and 18 extending in the longitudinal axis of the frame 3 are formed at the upper ends of the outer projections 15 and 16. Guide posts 19 and 20 are provided to project as separated and opposed laterally with respect to the frame axis on the expanded part 10 of the coil frame 3 with a spacing larger than the width in the lateral direction of the flange part 8. Said guide posts 19 and 20 constitute a positioning means for the respective members to be assembled, through which the posts are inserted, as stacked on the electromagnet assembly 1. Lead out wires 21 and 22 of the coil 4 are fused to inward projecting ends 25*a* and 26*a* of coil terminals 25 and 26 projecting long in the horizontal direction from the outside wall of the expanded part 10 respectively through grooves 23 and 24 formed in the coil side end edge of the expanded part 10 of the coil frame 3. At this time, guide pins 27 and 28 provided adjacent the grooves 23 and 24 to project near both ends in the lateral direction of the flange part 8 functions in that the lead out wires 21 and 22 will be smoothly introduced into the grooves 23 and 24.

A substantially rectangular frame shaped armature 30 guided at one end corners corresponding to the guide projections 11 and 12 of the electromagnetic assembly 1 so as to be loosely fitted around the flange parts 7 and 8 has notches 31 and 32 formed in the corner parts at the other end to oppose the expanded part 5 of the iron core 2 and has an arcuate spring 33 fixed in the middle part to the back surface on the first mentioned end side which is to be in contact with the expanded part 6. Said arcuate spring 33 is pressed at both ends against a step part 39 formed on the half opened side of the inner surface of a casing 35 half opened on one side and provided with notches 36 and 37 as opposed in both corners. In other words, when the device is assembled, the armature 30 will be pressed against the expanded part 6 of the iron core by the spring force of the arcuate spring 33 pressed at both ends against the step part 39 of the casing 35 so that the armature will be prevented from floating up and a stabilized operation of the armature will be insured.

Figure 3:
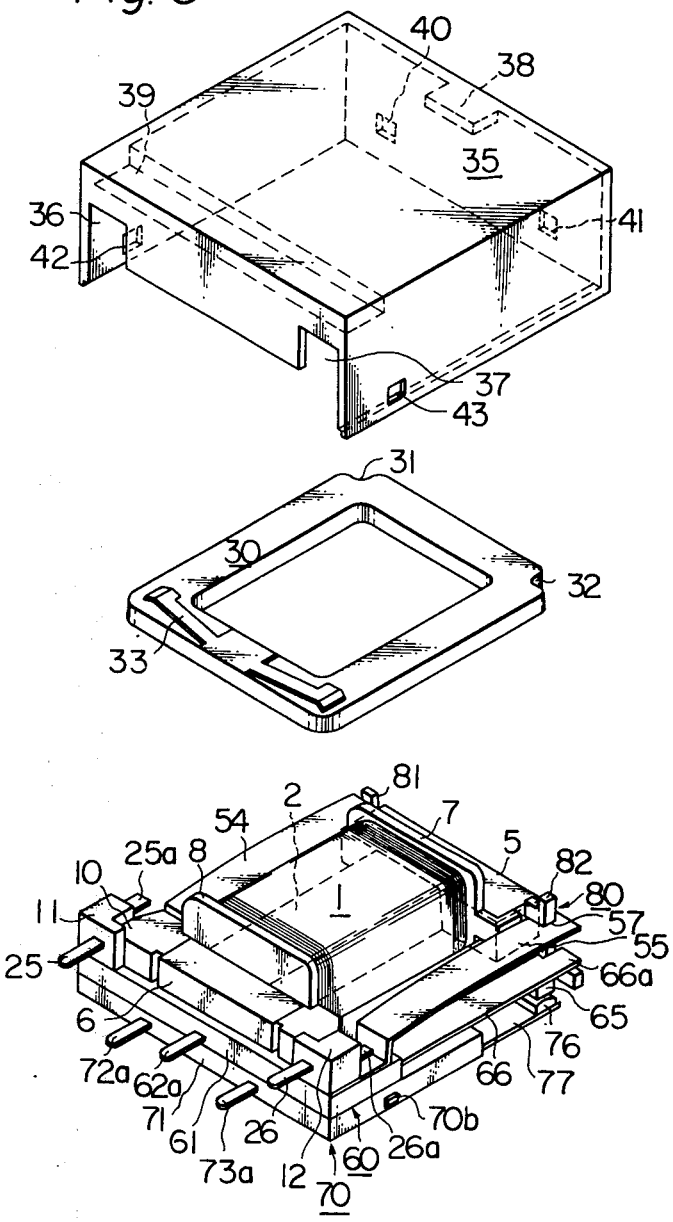
FIG. 3 is a perspective view of the relay of FIGS. 1 and 2 as assembled and seen from the reverse side, but with the armature and casing as disassembled and with the cover plate removed.
Figure 4:
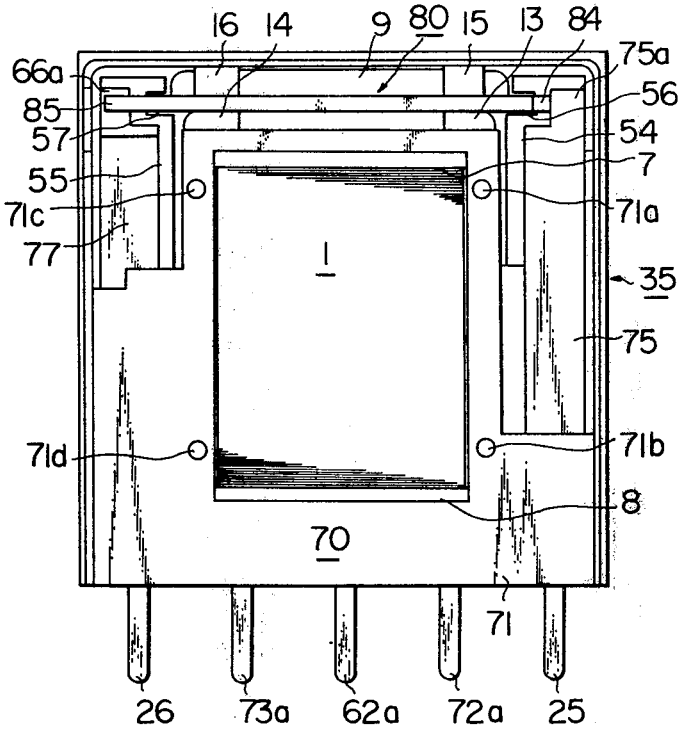
FIG. 4 is a plan view as seen from the side of the cover plate removed of the electromagnetic relay of FIGS. 1 to 3 in the assembled state.
Figure 5:
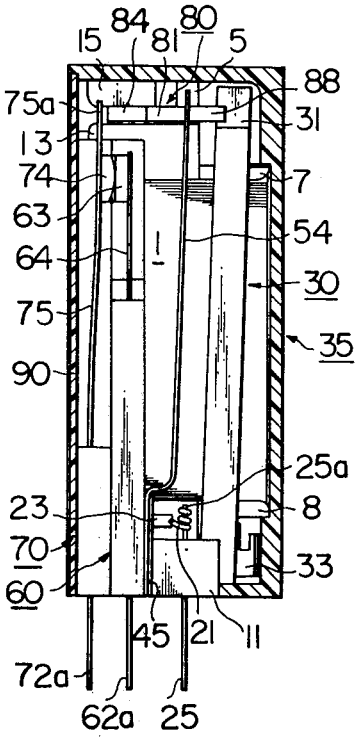
FIG. 5 is a side elevation of the relay of FIG. 4 including the cover plate but with the casing and cover plate shown in section.
Figure 6:
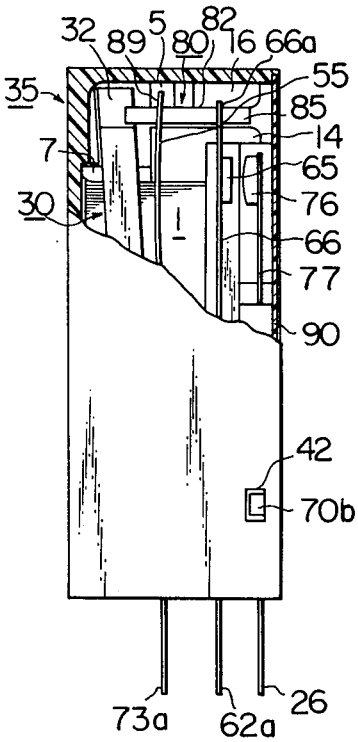
FIG. 6 is a side elevation at the reverse side to FIG. 5 of the relay of FIG. 4 including the cover plate but with the casing and cover plate partly sectioned for showing contact part.
Figure 7:
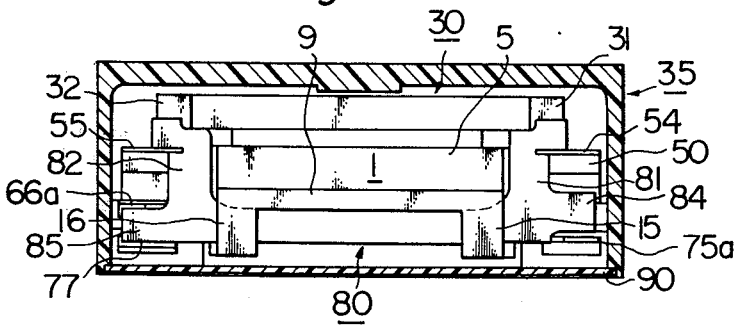
FIG. 7 is a top view of the relay of FIG. 4 including the cover plate but with the casing and cover plate sectioned.

The step part 39 of the casing 35 acts to guide and position the flange parts 7 and 8 of the electromagnetic assembly 1 together with a step part 38 formed partly on the side opposed to the step part 39 (see FIG. 3). Therefore, the inside dimensions of the step parts 39 and 38 are respectively substantially equal to the outside dimensions of the flange parts 7 and 8. A pair of holes 40 and 41 are made as separated from each other in the side wall opposed to the half opened wall of the casing and are designed to be able to receive projections 17 and 18 extending in the horizontal direction at the upper ends of the outer projections 15 and 16 of the electromagnetic assembly 1. Said holes 40 and 41 act as a proper means for positioning and holding the electromagnet assembly 1 but may be formed to be recesses if the thickness of the casing side wall is sufficient. Holes 42 and 43 which can be likely recesses are made as opposed near the half opened side wall on the other opposing side walls, as designed to receive an engaging means provided in the uppermost member of the later described group of members mounted on the electromagnet assembly 1 through the guide posts 19 and 20.

An insulating spacer 45 having a notch 46 of a width larger than the width in the lateral direction of the flange part 8 of the electromagnet assembly 1 formed to have holes 47 and 48 separated in the longitudinal direction of the spacer 45 so as to be fitted to the guide posts 19 and 20 is formed with a plastic or preferably polyester sheet, which electrically insulates a balance spring 50 stacked on it from the lead out wires of the coil of the electromagnet assembly 1. Holes 52 and 53 are made in the middle part 51 of said balance spring 50 which is formed preferably of steel or the like so as to be fitted to the guide posts 19 and 20. Slits 56 and 57 opened inward are respectively formed near the ends of leg pieces 54 and 55 of the balance spring 50 and are so designed as to be engaged respectively with the leg parts of the later described card but can be selectively modified if the balancing spring is well pressed at both leg ends against the card. For example, the leg pieces 54 and 55 may be notched in the inner end corners. Further, the parts near the middle parts 51 of the leg pieces 54 and 55 are bent in the form of steps to increase the spring force of the balance spring. The leg piece 55 which opposing the later described normally opened contact side is given a spring force larger than that of the other leg piece 54 so as to keep a sufficient normally opened contact distance. In other words, the leg piece 55 is inclined so that the tip of the leg piece 55 will be positioned below the tip of the leg piece 54. When the leg piece 55 is inclined and the respective leg pieces 54 and 55 are contacted with the card in the same state, the spring force of the leg piece 55 will become larger than that of the leg piece 54.

A substantially rectangular frame-shaped first contact spring block 60 which is placed on the balance spring 50 on the electromagnet assembly 1 and can be contacted at the inner edge with the flange parts 7 and 8 of the electromagnet assembly is provided with a holding frame 61 made of a plastics, in which a substantially U-shaped conductor 62 having a resiliency is partly embedded integrally. A normally closed stationary contact spring 64 having a normally closed stationary contact 63 fixed near the tip is short exposed on one side of the first contact spring block 60, while a normally opened movable contact spring 66 having a normally opened movable contact 65 fixed is long exposed on the opposite side. Further, this movable contact spring 66 is provided with an extended engaging part 66*a* which is longer and narrower than the stationary contact spring 64 and can be contacted with the shoulder of the card. Further, the holding frame 61 is so formed that its an end surface will be flush with the half opened side of the casing 35. A terminal 62a provided as connected with the conductor 62 or formed integrally therewith is extended in the horizontal direction on said end surface. In addition, fitting holes 67 and 68 penetrating through the conductor 62 are made in the holding frame 61 at corresponding positions to the guide posts 19 and 20 so that the first contact spring block 60 will be fitted to the guide posts 19 and 20 on the electromagnet assembly.

A second contact spring block 70 having a shape similar to the first contact spring block 60 is provided with a holding frame 71 of a plastics in which a pair of L-shaped conductors 72 and 73 are respectively partly embedded as opposed to each other so as to be integral with the frame 71. A normally closed movable contact spring 75 to which a normally closed movable contact 74 is fixed is long exposed on one side of the second contact spring block 70, while a normally opened stationary contact spring 77 to which a normally opened stationary contact 76 is fixed is short exposed on the opposite side. The movable contact spring 75 is provided with an extended engaging part 75a which is longer and narrower than the stationary contact spring 77 and can be contacted with the shoulder of the card. Further, the holding frame 71 is so formed that its an end surface will be flush with the half opened side of the casing 35. Terminals 72*a* and 73*a* provided respectively as connected or formed integrally with the conductors 72 and 73 are extended in the horizontal direction on said end surface. Fitting holes 78 and 79 penetrating respectively through the conductors 72 and 73 are made in the holding frame 71 at corresponding positions to the guide posts 19 and 20 so that the second contact spring block 70 will be fitted to the guide posts 19 and 20 on the electromagnet assembly. In addition, projections 70*a* and 70*b* to be engaged with holes 42 and 43 in the casing 35 are made on the side walls of the holding frame 71. Cover engaging pins 71*a* to 71*d* are provided to project upward in the inner peripheral part of the holding frame 71. When the normally closed contacts and normally opened contacts of the first and second contact spring blocks are stacked on the electromagnet assembly 1, the distance of these contacts from the surface of the coil 4 will be well secured so that any possible contact arc will have not influence on the coil.

A card 80 to be loosely inserted between the inner projections 13 and 14 and outer projections in the electromagnet assembly 1 is formed an insulative material such as a plastics or preferably Bakelite and is provided with leg parts 81 and 82. On one leg part 81 side of the card, a notch 83 in which the engaging part 75*a* of the normally closed movable contact spring 75 of the second contact spring block 70 is to be positioned when the normally closed contact is closed is formed and a projecting arm 84 to open the normally closed contacts 63 and 74 by pressing with it the engaging part 75*a* against the resiliency of the movable contact spring 75 is extended. On the other side having the leg part 82 of the card 80, there is provided an inhibiting projecting arm 85 as extended to engage at its stopping surface the engaging part 66*a* of the normally opened movable contact spring 66 in the first contact spring block 60 so as to normally inhibit the normally opened movable contact 65 from contacting the stationary contact 76 against the resiliency of the contact spring 66 so that the normally opened contacts 65 and 76 will be kept open. Further, the respective leg parts 81 and 82 are bent outward and expanded substantially in the middle so that their inner shoulders 86 and 87 will be engageable with the edge parts 30*a* and 30*b* of the notches 31 and 32 in the armature 30 and their outer shoulders 88 and 89 will be positioned in the slits 56 and 57 in the leg pieces 54 and 55 of the balance spring 50 and, at the same time, will be engaged with the tips of the leg parts 54 and 55.

An insulative cover plate 90 having fitting holes 90*a* to 90*d* corresponding to the cover engaging pins 71*a* to 71*d* of the second contact spring block 70 will close all the opened surface of the casing when the above described respective members are assembled integral. Said cover plate 90 can be utilized as a name plate on which a trade mark and the like are printed or engraved.

The sequence of assembling the above described embodiment of the present invention shall be detailed in the following. A fixed amount of the coil 4 is wound on the coil frame 3 with which the iron core 2 and coil terminal 25 and 26 are made integral, and the lead-out wires 21 and 22 at the start and end of the winding of said coil 4 are inserted through the grooves 23 and 24 formed on the end edge on the coil side of the expanded part 10 and fused at the ends to the inward projecting ends 25*a* and 26*a* of the coil terminal to form an electromagnet assembly 1. The insulating spacer 45, balance spring 50 and first contact spring block 60 are stacked in turn on this electromagnet assembly 1. At this time, the guide post 19 located on the coil frame of the electromagnet assembly 1 is inserted through the holes 47, 52 and 67 in the respective members. In the same manner, the guide post 20 is inserted through the holes 48, 53 and 68 so that the respective members will be held in positions. At the same time, the opposed side of the first contact spring block 60 is fitted into the space between the flange part 7 and inner card holding projections 13 and 14. Thereby, the first contact spring block 60 is insured to be positively mounted and positioned on the electromagnet assembly 1 through the spacer 45 and balance spring 50.

Then, the card 80 is inserted into the space between the inner projections 13 and 14 and the outer projections 15 and 16 located for holding the card on the expanded part 9 of the coil frame 3 of the electromagnet assembly 1 so that the lower ends of the leg parts 81 and 82 as well as their inner shoulders 86, 87 of said card 80 will extend out of the surface of the expanded part 5 of the core 2 as resiliently urged by the balance spring 50 engaged at the outer shoulders 88 and 89. Further, the second contact spring block 70 is stacked on the first contact spring block 60 so that the fitting holes 78 and 79 will be fitted to the guide posts 19 and 20 and the opposed sides will be fitted in the spaces between the flange part 7 and the inner projections 13 and 14. After the second contact spring block 70 is fitted, the guide posts 19 and 20 are fixed to the second contact spring block 70 by calking with a heat the respective ends of the posts 19 and 20. By the above described assembling operation, the balance spring 50 will be engaged from outside with the leg parts 81 and 82 of the card 80 through the slits 56 and 57, while a pair of the normally closed stationary contact spring 64 having the normally closed stationary contact 63 and the normally closed movable contact spring 75 having the normally closed movable contact 74 and the other pair of the normally opened movable contact spring 66 having the normally opened movable contact 65 and the normally opened stationary contact spring 77 having the normally opened stationary contact 76 are respectively faced with each other.

As a result, the required relative positions of the first and second contact spring blocks 60 and 70 and card 80 will be secured, a desired contact pressure will be secured between the normally closed stationary contact 63 and normally closed movable contact 74 and, as the spring force of the leg piece 55 of the balance spring 50 is provided to be large by the spring force of the leg piece 54, the clearance or contact distance between the normally opened movable contact 65 and normally opened stationary contact 76 will be well insured. This means that the normally closed contacts are maintained in the state as of before the operation of the closed relay. It is possible to have the leg parts 54 and 55 of the balance spring 50 engaged with the leg parts 81 and 82 of the card simultaneously with the insertion of said card 80 between the card holding projections of the electromagnet assembly 1.

Further, the armature 30 is assembled in such manner that the end side on which the arcuate spring 33 is fixed to the back surface is contacted with the expanded part 6 of the iron core 2 of the electromagnet assembly 1 with the spring 33 exposed outside, as guided by the flange part 8 and guide projections 11 and 12, and the other end side having the notches 31 and 32 of the armature 30 is placed on the inner shoulders 86 and 87 as guided by the flange part 7 so that this notched end side will be resiliently held away from the expanded part 5 of the core 2 by the force of the spring 50 given through the card 80.

Figure 2:
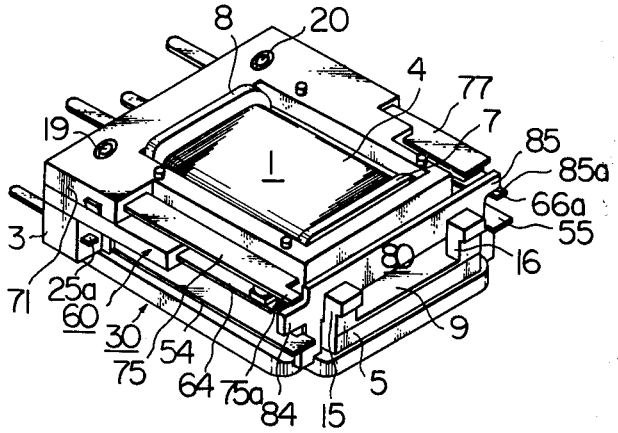
FIG. 2 is a perspective view as seen in the same direction as in FIG. 1 of the respective members as assembled except the casing and cover plate.

The unit assembled as described above is then housed in the casing 35 so that the flange parts 7 and 8 will be positioned adjacent the step parts 38 and 39 of the casing 35, the arcuate spring 33 of the armature will be pressed at both end parts resiliently against said step part 39 and, at the same time, the outside surface expanded out of the guide projections 11 and 12 of the coil frame 3 and the end surface on which the respective terminals 62 and **72*a*, 73*a* of the first and second contact spring blocks 60 and 70 are disposed will be positioned in the notches 36 and 37 and the half opened part on the half opened side of the casing 35 so as to be substantially flush with said side of the casing. This assembled unit is shown in FIG. 2**.

Finally, after the unit is housed in the casing 35, the cover plate or name plate 90 will be fitted to the opened side of the case to close it so that the plate 90 will compress the spring 33 of the armature 30, thereby the spring-provided side of the armature 30 is urged to close contact with the expanded part 6 of the core 2. At this time, the holes **90*a* to 90*d* will receive therein the cover engaging pins 71*a* through 71*d* of the second contact spring block 70. When these pins 71*a* through 71*d* are heat-calked to join the cover plate in this state, the assembly operation of the electromagnetic relay will be completed. The electromagnetic relay as contained in the casing 35 is shown in FIGS. 4 to 7**.

Further, the dynamical operation of the relay according to the present invention shall be detailed. When the coil of the electromagnet assembly 1 is excited and the armature 30 is attracted on the side having the notches 31 and 32 to the expanded part 5 of the iron core 2, the card 80 abutting at its inner shoulders 86 and 87 the edges **30*a* and 30*b* of the armature 30 will be pushed by the armature attracted against the spring force of the leg pieces 54 and 55 of the balance spring 50 which are engaged with the outer shoulders 88 and 89 of the card so as to be shifted to be away from the expanded part 5 as guided by the card projections 13 to 16. Following this operation, the engaging part 75*a* of the normally closed movable contact spring 75 will be pressed in the same direction as the shifted direction of the card by the projecting arm 84 of the card, the normally closed contacts will be opened, the engaging part 66*a* of the normally opened movable contact spring 66 will be released from the stopping surface 85*a* of the inhibiting projecting arm 85** of the shifted card and the normally opened contacts will be closed.

Figure 8:
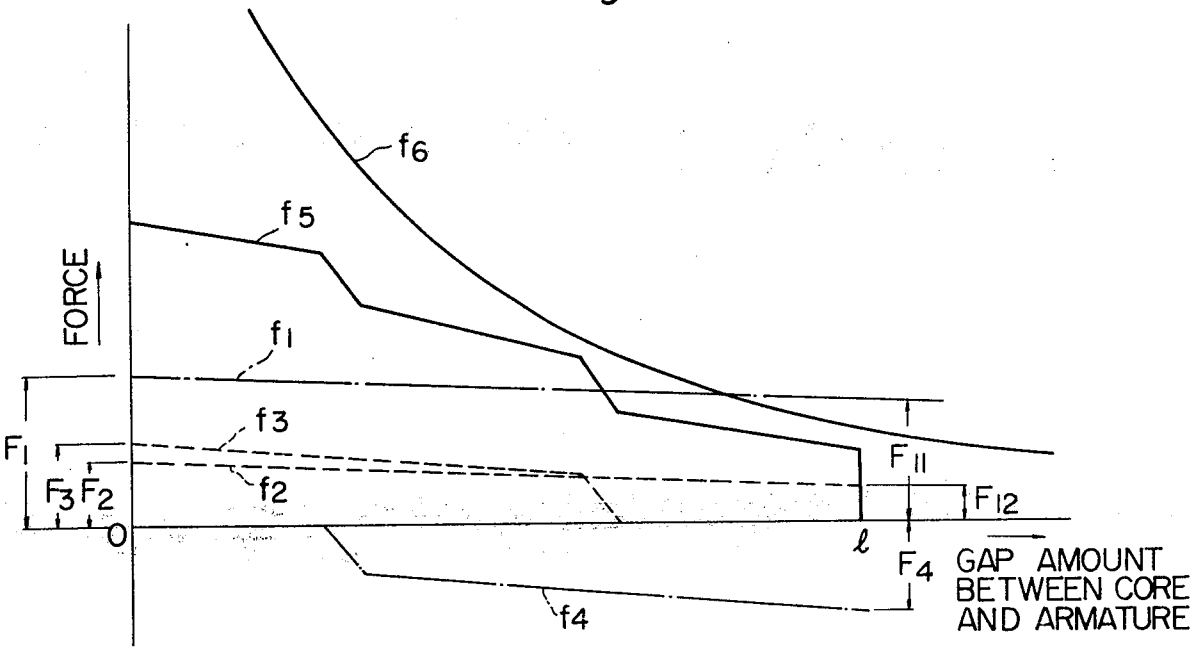
FIG. 8 is a diagram showing correlations between operating forces of respective moving members in the embodiment of FIGS. 1 – 7.

Further, the correlations of the forces of the moving members during the above described contact relaying operation shall be considered with reference to FIG. 8. In the drawing, on the ordinate, forces are taken so as to indicate the spring force or attraction of the moving member and, on the abscissa, gap amounts between the surface of the expanded part 5 of the iron core of the electromagnet assembly and the attracted surface of the armature 30 on the side on which the notches 31 and 32 are formed are taken. The position l on said abscissa indicates a state wherein the gap is zero, that is, the armature 30 is perfectly attracted to the expanded part 5 of the iron core. As described above, the leg piece 55 of the balance spring 50 is inclined, its spring force $f_1$ is so set as to be always larger than the spring force $f_2$ of the other leg piece 54 over the state before the relaying operation where the gap is maximum to the state after the operation where the gap is zero, in addition, the spring force $F_1$ of the leg piece 55 before the operation is so set as to be substantially equal to the sum of the spring force $F_2$ at that point of the other leg piece 54 and the spring force $F_3$ at that point of the normally closed movable contact spring 75 and the spring force $F_{11}$ of the leg piece 55 after the operation is so set as to be substantially equal to the sum of the respective absolute values of the spring force $F_{21}$ at that point of the other leg piece 54 and the spring force $F_4$ at that point of the normally opened movable contact spring 66.

When the armature 30 is attracted to the iron core 2 of the electromagnet assembly 1 and the attraction $f_6$ is added, the spring force $f_2$ of the leg piece 54 of the balance spring will contribute to keep the balance of the resultant total spring force $f_5$. In other words, even if, when the card 80 is shifted, the card pressing projecting arm 84 presses the engaging part **75*a* of the normally closed movable contact spring 75 and the negative spring force $f_4$ of the normally opened movable contact spring acts, that is, the normally opened movable contact is released from the card to close the normally opened contacts, the pressing projecting arm 84 of the card pushes the engaging part 75*a* of the normally closed movable contact spring 75** to open the normally closed contacts and the normally closed movable contact spring force $f_3$ is added to the card, the balance of the card will be maintained and the smooth opening and closing operation of the electromagnetic relay will be achieved.

Figure 9:
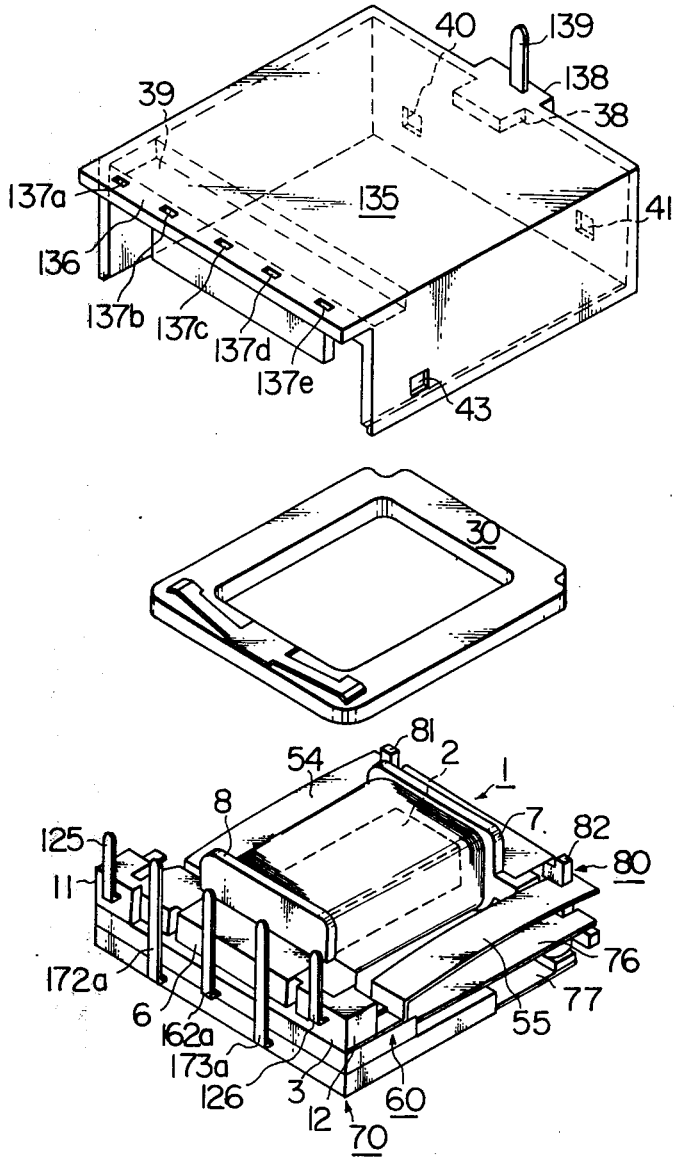
FIG. 9 is a perspective view similar to FIG. 3, showing another embodiment of the electromagnetic relay of the present invention.

In the foregoing descriptions, a vertically installed electromagnetic relay most favorably utilized in the case of reducing the fitting area is disclosed. On the other hand, a horizontally installable embodiment of the electromagnetic relay which is favorable in the case that the fitting height is limited is shown in FIG. 9. For the brevity of the explanation, the same corresponding numerals are attached respectively to the same members or parts as in the embodiment shown in FIGS. 1 through 7. In the present embodiment, coil terminals 125 and 126 projecting out of the end surface of the coil frame 3 of the electromagnet assembly, contact terminal 162*a* projecting out of the end surface of the first contact spring block 60 and contact terminals 172*a* and 173*a* of the second contact spring block 70 are bent substantially at right angles adjacent the said end surface. Further, the respective terminals are adjusted in their lengths so as to be substantially aligned at the tips. The casing 135 to house the unit has a skirt 136 extended at right angles to the half opened side and in the horizontal direction. Said skirt has holes 137*a* to 137*e* aligned so as to be able to have said terminals projected out of the skirt.

Therefore, when the terminals 125, 172*a*, 162*a*, 173*a* and 126 are inserted respectively through the holes 137*a* to 137*e* in the skirt 136 of the casing 135 in housing the unit therein, a horizontal type electromagnetic relay provided internally with the same unit as of the mechanism of the electromagnetic relay shown in FIGS. 1 through 7 can be easily realized. In this embodiment, further, it is desirable to provide a fixing projecting piece 139 extending vertically on a projection 138 extended on the side opposed to said skirt 136 so as to be utilizable in the case of fitting the relay to a printed base plate or the like.

With the above described formation, the electromagnetic relay of the present invention is provided with such effective positioning means as can unify the members to be stacked in the electromagnet assembly in only one vertical assembling direction, therefore, the automation of assembling the device can be realized and the device can be produced at a lower cost. Further, the coil of the electromagnet assembly is made a center, the other members are so arranged as to enclose the coil, particularly the normally closed contacts and normally opened contacts are so arranged as to be positioned on both sides of the coil as constantly separated from the coil and, therefore, the electromagnetic relay can be formed to be flat or thin and can be utilized either as a vertical type which is adapted to be limited in the fitting area or as a horizontal type which is limited in the fitting height. Further, during the operation, the balance of the card can be well maintained by the effective balancing means. As the relay has an armature attracting characteristic of a high sensitivity, the stability is high and the operation is severe and can be actuated with a low input. Further, as the normally closed contacts and normally opened contacts are arranged on both sides of the axis of the electromagnet assembly and the relay operation can be performed with a well balanced spring force, the contacts can be smoothly opened and closed and are not likely to be deteriorated. Thus, a device provided with a contact capacity from a low level to a high level can be provided.

What is claimed is:

1. An electromagnetic relay comprising an electromagnet assembly including means for positioning respective component members to be stacked providing thereto a single assembling direction, said assembly comprising an iron core and coil frame formed integral and having a coil wound substantially in the middle, an armature to be attracted to said iron core of the electromagnet assembly when said coil is excited, a balance spring formed to provide a constant spring force to said armature resistive to attracting force thereto of said electromagnet assembly and stacked on the electromagnet assembly through said positioning means, first and second contact spring blocks having normally closed contacts and normally opened contacts respectively positioned on each side along longitudinal axis of said electromagnet assembly and stacked on said balance spring through the positioning means, a card normally biased by said balance spring to non-attracted position of the armature and adapted to open said normally closed contacts and to close said normally opened contacts in response to the attracted movement of the armature, and a casing adapted to house therein a stacked assembly unit of respective said members, said positioning means including guide posts and respective said members to be stacked on the electromagnet assembly are provided with holes through which said guide posts are inserted.

2. An electromagnetic relay comprising an electromagnet assembly including means for positioning respective component members to be stacked providing thereto a single assembling direction, said assembly comprising an iron core and coil frame formed integral and having a coil wound substantially in the middle, an armature to be attracted to said iron core of the electromagnet assembly when said coil is excited, a balance spring formed to provide a constant spring force to said armature resistive to attracting force thereto of said electromagnet assembly and stacked on the electromagnet assembly through said positioning means, first and second contact spring blocks having normally closed contacts and normally opened contacts respectively positioned on each side along longitudinal axis of said electromagnet assembly and stacked on said balance spring through the positioning means, a card normally biased by said balance spring to non-attracted position of the armature and adapted to open said normally closed contacts and to close said normally opened contacts in response to the attracted movement of the armature, and a casing adapted to house therein a stacked assembly unit of respective said members, said electromagnet assembly including means for slidably supporting said card, and said supporting means comprising inner projections and outer projections which are opposed to each other at a spacing adapted to loosely fit the card therebetween and provided to project from the coil frame in the same direction as of said guide posts on the opposed side thereto.

3. An electromagnetic relay according to claim 2 wherein said card has a part engageable with said armature so as to respond to the attracted motion of the armature and a part with which said balance spring is engaged.

4. An electromagnetic relay comprising an electromagnet assembly including means for positioning respective component members to be stacked providing thereto a single assembling direction, said assembly comprising an iron core and coil frame formed integral and having a coil wound substantially in the middle, an armature to be attracted to said iron core of the electromagnet assembly when said coil is excited, a balance spring formed to provide a constant spring force to said armature resistive to attracting force thereto of said electromagnet assembly and stacked on the electromagnet assembly through said positioning means, first and second contact spring blocks having normally closed contacts and normally opened contacts respectively positioned on each side along longitudinal axis of said electromagnet assembly and stacked on said balance spring through the positioning means, a card normally biased by said balance spring to non-attracted position of the armature and adapted to open said normally closed contacts and to close said normally opened contacts in response to the attracted movement of the armature, and a casing adapted to house therein a stacked assembly unit of respective said members, said positioning means of the electromagnet assembly being so formed that said coil will be placed centrally and respective said members will be positioned to enclose the coil, said armature being provided with a resilient means at stationarily supported side of the armature so as to prevent said side opposed to the attracted side from floating up and to insure a stabilized operation of the armature, said spring means being formed as an arcuate spring which is fixed to the armature in the middle part and contacted with inside surface of the casing in both end parts.

5. An electromagnetic relay comprising an electromagnet assembly including means for positioning respective component members to be stacked providing thereto a single assembling direction, said assembly comprising an iron core and coil frame formed integral and having a coil wound substantially in the middle, an armature to be attracted to said iron core of the electromagnet assembly when said coil is excited, a balance spring formed to provide a constant spring force to said armature resistive to attracting force thereto of said electromagnet assembly and stacked on the electromagnet assembly through said positioning means, first and second contact spring blocks having normally closed contacts and normally opened contacts respectively positioned on each side along longitudinal axis of said electromagnet assembly and stacked on said balance spring through the positioning means, a card normally biased by said balance spring to non-attracted position of the armature and adapted to open said normally closed contacts and to close said normally opened contacts in response to the attracted movement of the armature, and a casing adapted to house therein a stacked assembly unit of respective said members, said balance spring being of substantially a U-shape having two legs, said legs resiliently engaging said card at their tips, and one of said legs which receives a spring force of said normally opened contacts being inclined by a larger angle with respect to base part of said U-shape than the other leg so as to maintain said constant spring force of the balance spring.

6. An electromagnetic relay according to claim 5 wherein spring force of said larger inclined leg of the balance spring is set to be always larger than that of the other leg over entire state of non-attraction of the armature where gap distance between said iron core of the electromagnet assembly and said armature being maximum and full-attraction of the armature where the gap distance being zero.

7. An electromagnetic relay comprising an electromagnet assembly including means for positioning respective component members to be stacked providing thereto a single assembling direction, said assembly comprising an iron core and coil frame formed integral and having a coil wound substantially in the middle, an armature to be attracted to said iron core of the electromagnet assembly when said coil is excited, a balance spring formed to provide a constant spring force to said armature resistive to attracting force thereto of said electromagnet assembly and stacked on the electromagnet assembly through said positioning means, first and second contact spring blocks having normally closed contacts and normally opened contacts respectively positioned on each side along longitudinal axis of said electromagnet assembly and stacked on said balance spring through the positioning means, a card normally biased by said balance spring to non-attracted position of the armature and adapted to open said normally closed contacts and to close said normally opened contacts in response to the attracted movement of the armature, and a casing adapted to house therein a stacked assembly unit of respective said members, said positioning means of the electromagnet assembly being so formed that said coil will be placed centrally and respective said members will be positioned to enclose the coil, wherein said first and second contact spring blocks respectively comprise a pair of conductor spring parts extending along respective said sides of the electromagnet assembly and having respectively a contact adjacent their tips to form said normally opened and closed contacts, and means for supporting respective said spring parts as electrically insulated from other elements; one of said pair of conductor spring parts of the first contact spring block which forms a part of the normally opened contacts is exposed longer out of said supporting means than the other conductor spring part which forms a part of the normally closed contacts so as to have a larger resiliency for rendering its contact to be a movable contact of the normally opened contacts, and is provided at the tip with an extended part for engaging said card so that said normally opened movable contact will be biased by the card in contact opening direction, the other conductor spring part of the first contact spring block being electrically connected with said conductor spring part and adapted to render said contact to be a stationary contact of the normally closed contacts; one of said pair of conductor spring parts of the second contact spring block which forms a part of the normally closed contacts is exposed longer outer of the supporting means than the other conductor spring part which forms a part of the normally opened contacts so as to have a larger resiliency for rendering its contact to be a movable contact of the normally closed contacts opposing said normally closed stationary contact of the first contact spring block, said the other conductor spring part being electrically insulated from said spring part having said normally closed movable contact, and is provided at the tip with an extended part for engaging the card when the card responded to the attracted motion of the armature so as to open the normally closed contacts, and said contact of the other spring part of the second contact spring block forming a part of the normally opened contacts is rendered to be a stationary contact of the normally opened contacts as opposed to said normally opened movable contact of the first contact spring block.

8. An electromagnetic relay according to claim 7 wherein said normally closed contacts and normally opened contacts of the first and second contact spring blocks are separated from said coil by a distance well enough for that any arc produced between the contacts will not affect the coil.

9. An electromagnetic relay according to claim 7 wherein said card is provided with a projecting arm which urges said extended part of the normally closed movable contact spring to open the normally closed contacts, an inhibiting projecting arm which inhibits and holds said extended part of the normally opened movable contact spring, an inner shoulder part engageable with a notch provided in the armature and an outer shoulder part engageable with the balance spring.

* * * * *